United States Patent [19]

Goussios

[11] 4,121,344

[45] Oct. 24, 1978

[54] UNIVERSAL DRAFTING TRIANGLE

[76] Inventor: Constantine C. Goussios, 37 Chaffee Ave., Albertson, N.Y. 11507

[21] Appl. No.: 766,877

[22] Filed: Feb. 9, 1977

[51] Int. Cl.[2] ..... B43L 13/24

[52] U.S. Cl. ..... 33/110; 33/95

[58] Field of Search ..... 33/95, 103, 110, 79, 33/80, 81, 108

[56] References Cited

U.S. PATENT DOCUMENTS

| | | | |
|---|---|---|---|
| 496,825 | 5/1893 | Gillet | 33/81 |
| 1,213,664 | 1/1917 | McCuaig et al. | 33/81 |
| 1,505,873 | 8/1924 | D'erams | 33/110 |
| 2,805,479 | 9/1957 | Droste | 33/80 |
| 2,893,126 | 7/1959 | Coallier | 33/103 |
| 3,762,055 | 10/1973 | Citrin | 33/81 |

*Primary Examiner*—Charles E. Phillips
*Attorney, Agent, or Firm*—Constantine A. Michalos

[57] ABSTRACT

A universal drafting triangle comprising a lower or first triangle laminate having a surface groove spaced from and along its three sides with rollers adjacent to angles of the triangle and connecting with the groove and a drive wheel adjacent to the remaining angle of the triangle and connecting with the groove. A belt drive such as an "O" ring is disposed within the groove and wrapped around the rollers and wheel. A raised track is disposed on the triangle laminate adjacent to one side of the triangle and spaced from the groove along that side. A slide member is adapted for sliding along the track and has an indentation for entrapping a portion of the "O" ring riding inside the groove adjacent to the track. The sliding member is in turn connected to a second solid triangle which is adapted for sliding along the adjacent side of the triangle laminate. The two rollers and wheel are disposed in indentations communicating with the grooves. A third triangle laminate is disposed over the first triangle laminate to enclose the rollers, drive wheel, "O" ring and slide.

2 Claims, 10 Drawing Figures

IV
III
II
VI
VII
8
10
11
12
14
16
18
20
22
24
26
28
30
32
34
35
36
38
40
42
44
46
48
50
52
54
56
58
60
62
64
66
68
70

UNIVERSAL DRAFTING TRIANGLE

BACKGROUND OF THE INVENTION

1. Field of the Invention

This invention relates in general to drafting equipment and in particular to a new and useful universal triangle which utilizes a first right triangle having a second triangle slideably connected along one edge of the right triangle.

2. Description of the Prior Art

In the field of drafting it is a well known technique to utilize a T-square or a parallel straight edge in drawing all horizontal lines on a drafting table. To draw vertical lines, it has also been known to use a right triangle with one side resting and sliding along the T-square or parallel straight edge and utilizing the perpendicular side as a straight edge to draw the vertical line. In drafting situations involving highly detailed drawings, it is necessary to use both hands in manipulating the T-square and triangle arrangement. This continual movement contributes to the difficulty of preparing detailed drawings and also causes a marring of the drafting surface due to the constant motion of the drafting aids. Further, the time factor is reduced substantially by use of a single-hand manipulation rather than utilizing both hands and more aids.

The present invention is directed toward alleviating these difficulties in preparing detailed drawings.

SUMMARY OF THE INVENTION

The application relates to a universal drafting triangle which comprises a bottom or first triangle laminate which has a groove milled into its surface at a location spaced from its three edges. Adjacent opposite angles of one side or circular indentations communicating with the groove on that side. In these two circular indentations are two rollers which are adapted for engagement with a flexible "0" ring disposed within the groove. Adjacent to the remaining angle there is a larger indentation which also communicates with the groove in this area. A finger-manipulated, large drive wheel is rotatably mounted within this larger indentation and is also adapted for guiding the belt drive or "0" ring around its included angle.

Along the vertical side groove in and spaced from the triangle vertical edge is a rectangular indentation along and between the two rollers. Within this indentation there is disposed a raised track or guide.

A slide element is slideably mounted over this track and has a cylindrical indentation on its lower surface for trapping and securing a portion of the "0" ring in the groove adjacent the track or guide. A portion of the slide element extends beyond the vertical edge of the triangle adjacent the track, and is adapted for attachment to a second triangle. In operation, when the large drive wheel is rotated, the second triangle is moved along the vertical edge of the first triangle as the slide element slides along the track by virtue of its engagement with the "0" ring and drive wheel.

A third or top triangle laminate is disposed over the first triangle laminate and encloses the rollers, wheel and slide arrangement thereunder. A semi-circular aperture is provided in the top or third triangle laminate over the wheel to provide access to the wheel and enable the draftsman to rotate the wheel and thus move the slide which is connected to the second triangle along the vertical edge of the first triangle. It shall also be noticed that this unit is versatile in that it may be wholly flipped over and used with the large drive wheel on the left of the vertical edge. Thereby there is also located a second semi-circular aperture at the first triangle directly opposite the semi-circular aperture of the third triangle.

In another embodiment of the invention, a longitudinal, dovetailed groove is provided along the top edge of the second triange to accept a drafting square having two arms having graduations for scaling. The dovetail groove can be provided with a base magnet and the drafting square provided with a metallic dovetail insert for insuring positive connection of the drafting square to the second triangle.

To hold the second or top laminate down to the first or bottom triangle laminate, screw holes are provided at the two points of the two rollers and at the drive wheel arrangement to insert flat head screws therethrough.

In an additional embodiment of the invention, a knurled knob is provided attached to the drive wheel to enable the draftsman to rotate the wheel and thus move the second triangle along the vertical edge of the first triangle.

An object of the invention is to provide a universal drafting triangle which may be operated by one hand to simplify the drafting process and increase the speed at which small detailed drawing features can be prepared.

A further object of the invention is to provide a universal drafting triangle that is simple in design, rugged in construction and economical to manufacture.

The various features of novelty which characterize the invention are pointed out with particularity in the claims annexed and forming a part of this disclosure. For a better understanding of the invention, its operating advantages and specific objects attained by its uses, references should be made to the accompanying drawings and descriptive material in which there are illustrated preferred embodiments of the invention.

DESCRIPTION OF THE PREFERRED EMBODIMENT

Figures 1, 2, 3, 4, 5, 6, 7:
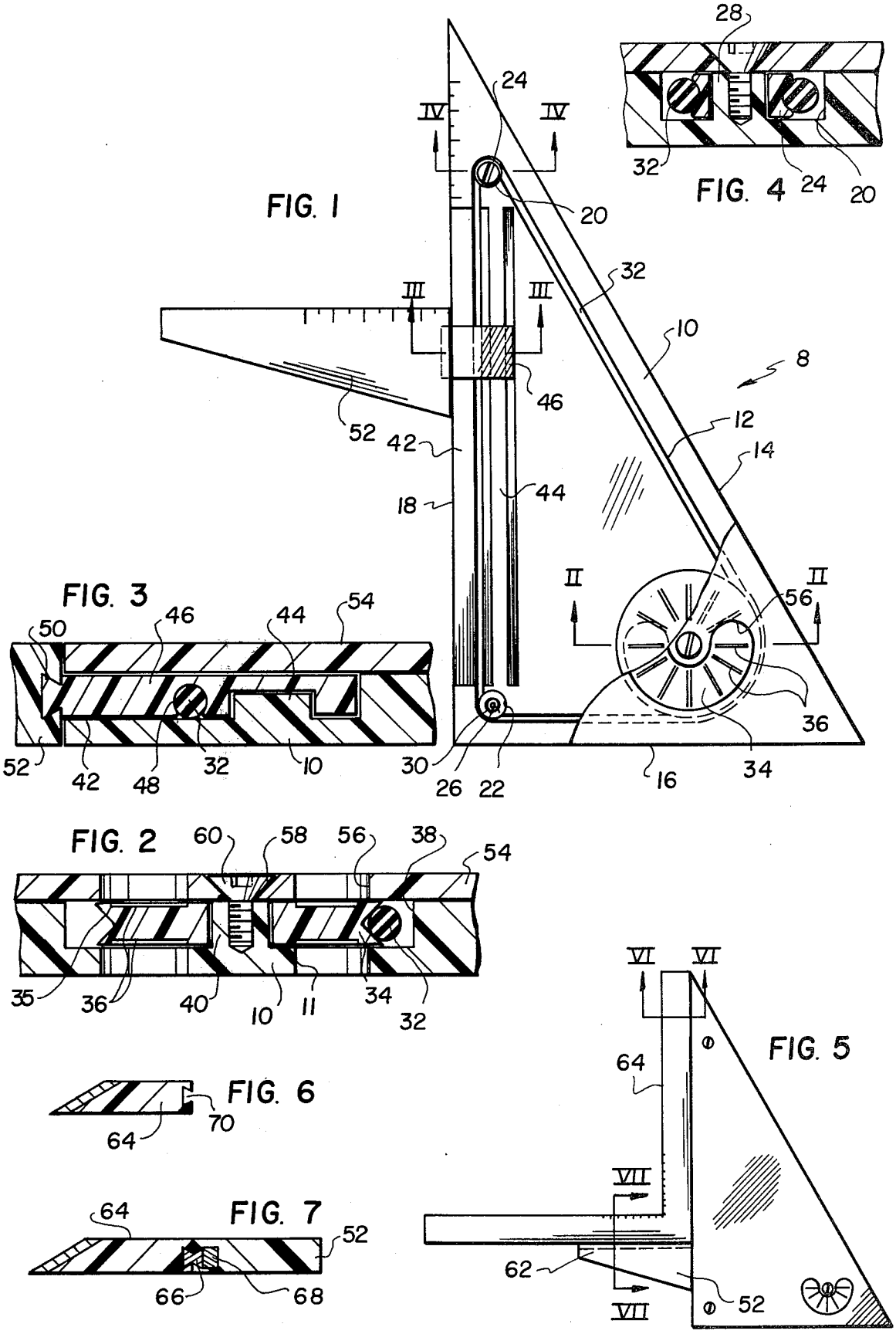
FIG. 1 is a partially cut away, plan view of one embodiment of the invention.
FIG. 2 is a longitudinal, cross-sectional view taken along lines 2—2 of FIG. 1.
FIG. 3 is a longitudinal, cross-sectional view taken along line 3—3 of FIG. 1.
FIG. 4 is a longitudinal, cross-sectional view taken along line 4—4 of FIG. 1, which includes a third triangular laminate.
FIG. 5 is a plan view of another embodiment of the invention using equal-sided drafting square with graduations.
FIG. 6 is a cross-sectional, longitudinal view taken along line 6—6 of FIG. 5.
FIG. 7 is a longitudinal, cross-sectional view taken along line 7—7 of FIG. 5 and rotated 90°.

Referring to the drawings in particular, the invention embodied therein in FIG. 1 comprises a universal drafting triangle 8 having a bottom trianglar laminate 10 having a groove 12 knurled into the surface thereof which is spaced from lateral edges 14, 16 and 18 of the triangular laminate 10. At the adjacent angles of edge 18 are circular indentations 20 and 22. In these circular indentations 20 and 22 are disposed rollers 24 and 26 which are mounted for rotation in the respective circular indentations 20 and 22 on hubs 28 and 30. This arrangement is best seen in FIG. 4.

Riding in the groove 12 is a continuous belt drive or "0" ring 32 which embraces rollers 24 and 26 as well as drive wheel 34. As best seen in FIG. 2, drive wheel 34 has a "V" groove 35 along its circumference to entrap and guide a portion of O-ring 32. Drive wheel 34 has surface knurlings 36 on both of its surfaces. Drive wheel 34 is adapted for rotation in a large circular indentation 38 and rotates on a hub 40. An elongated rectangular groove 42 is disposed in bottom triangular laminate 10 along edge 18. In the rectangular groove 42 is a raised guide or track 44 also running the length of the rectangular groove 42. A slide member 46 is adapted for sliding along the guide or track 44 and, as best seen in FIG. 3, has a circular groove 48 for entrapping a portion of the O-ring 32 to cause the slide 46 to be moveable along the guide 44 when the drive wheel 34 is rotated.

Rollers 24, 26 with drive wheel 34 and "O" 32 comprises a drive means which is connected, through the slide 46 to a second triangular laminate 52.

Slide 46 is provided with a dovetail extention 50 which is engagable into the dovetail groove of the second triangle 52. A third triangular laminate 54 is provided over laminate 10 and has a semicircular opening 56 for allowing access to the surface knurlings 36 of drive roller 34. Similarly, the bottom laminate 10 has a second semicircular opening 11 for providing access to the bottom knurlings 36 of the drive wheel 34. In addition, the third triangular laminate 54 has provided countersunk screw openings 58 which admit screws 60 which are screwed into the bottom laminate 10 at the hub locations 40, 30 and 28.

As best shown in FIG. 5, the second triange 52 can be provided with a second dovetail groove 62 which can engage a square 64 through an intermediate dovetail piece 66, as best seen in FIGS. 7 and 5. As seen in FIG. 6, the square 64 can also be provided with dovetail groove 70 for engagement with the dovetail piece 66 when the square 64 is to be used with the other of its legs engaged with the triangle 52. That is, the whole assembly of the universal drafting triangle 8 may be flipped over 180° to be used with the ede 18 on the right side of the assembly with the edge 16 remaining on the T-square or parallel straight edge (not shown).

Figure 8:
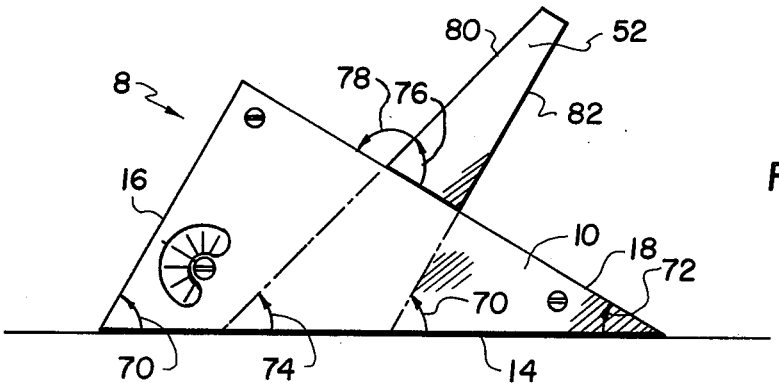
FIG. 8 is a plan view of the invention showing another way assembly may be utilized.

Referring to FIG. 8, it shall be noticed that this device is versatile in still another way. The whole assembly of the universal drafting triangle 8 may be utilized on a T-square or a parallel straight edge with the longest edge 14 of the first triangular laminate 10 supported on the T-square parallel straight edge.

In this position, the triangle 10 will have its 60° angle 70 on the left of edge 14 and its 30° angle 72 on the right, presenting for use by the draftsman a 45° angle 74 on the second triangle 52. It can be noted that triangle 10 and triangle 52 will have a 75° angle 76 therebetween.

The the draftsman can utilize in this position of the drafting triangle 8 the following angles: a 105° angle 78 by utilizing edges 80 of triangle 52 and edge 18 of triangle 10; a 60° angle by utilizing edge 16 of triangle 10; or a 30° or a 150° angle by utilizing edge 18 of triangle 10.

Figure 10:
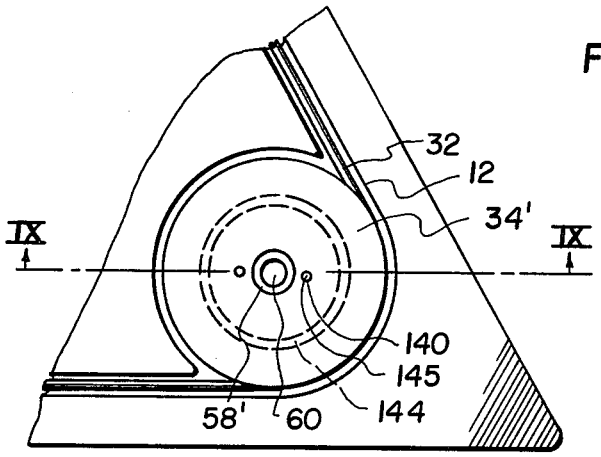
FIG. 10 is a partial, plan, cross-sectional view taken along line 10—10 of FIG. 9.
Figure 9:
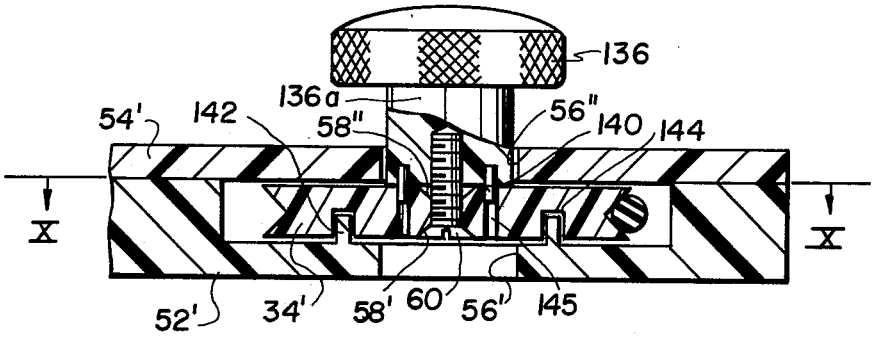
FIG. 9 is a longitudinal, cross-sectional view taken along line 9—9 of FIG. 10 of still another embodiment of the invention.

Referring to FIGS. 9 and 10, another embodiment of this invention includes a knurled knob or wheel 136 connected to the drive wheel 34' through screw 60'. Access to either side of wheel 34' is provided through holes 56' and 56'' in laminates 52' and 54' for the stem **136*a* of wheel 136. Positioning pins 140 are also attached to stem 136*a* to engage with bores 145 of drive wheel 34'. Annular guide 142 is also provided on laminates 52' to further guide wheel 34' through its annular guide slot 144**.

To aid the reversibility of the knob 136 on wheel 34', opposing countersinks 58', 58'' and provided on wheel 34' to admit screw 60.

While the preferred embodiment has been disclosed and described in detail, it will be understood that a different structure can be used without departing from the principles of the invention.

What is claimed is:

1. A universal drafting triangle comprising a first triangular laminate means having three lateral edges, a second triangular means also having three lateral edges with one edge of said first triangular means movably engaging one edge of said second triangular means whereby the one edge of said first triangular means forms a 90° angle with one other of said edges of said second triangular means, a drive means connected between said first triangular means and said second triangular means for moving one triangular means relative to the other, said drive means including a drive wheel located on said first triangular means for movement of said second triangular means by one hand manipulation of said drive wheel whereby a draftsman may operably draw a set of spaced parallel lines with one hand manipulation of said drive wheel, said drive wheel further including a knurled knob connected to said drive wheel and extending beyond said first triangular means, said drive means further including a guide means connected to said first triangular means for supporting said drive wheel, said drive wheel being provided with through holes accessible from either side of said first triangular means and pin means on said knurled knob for engaging said through holes for securing said knurled knob from either side of said first triangular means for insuring mutual rotation thereof from either side of said first triangular means.

2. The structure of claim 1 wherein said drive means further includes a pair of rotatably supported rollers located on said first triangle and spaced adjacent the one edge thereof, a slide member slidably connected adjacent to the one edge of said first triangle, and a belt drive rotatably connected to said drive wheel and said pair of rollers, said belt drive connected to said slide member and said slide member connecting to said second triangle whereby the drive wheel will drive the belt drive around said rollers to move said second triangle in a plane 90° to said first triangle by the one hand manipulation of said drive wheel by the draftsman.

* * * * *